US011498803B2

(12) United States Patent
Koskinen et al.

(10) Patent No.: US 11,498,803 B2
(45) Date of Patent: Nov. 15, 2022

(54) ELEVATOR CAR PARKING BRAKE

(71) Applicant: Kone Corporation, Helsinki (FI)

(72) Inventors: Antti Koskinen, Helsinki (FI); Jani Renvall, Helsinki (FI)

(73) Assignee: Kone Corporation, Helsinki (FI)

( * ) Notice: Subject to any disclaimer, the term of this patent is extended or adjusted under 35 U.S.C. 154(b) by 511 days.

(21) Appl. No.: 16/720,701

(22) Filed: Dec. 19, 2019

(65) Prior Publication Data

US 2020/0207576 A1 Jul. 2, 2020

(30) Foreign Application Priority Data

Dec. 31, 2018 (EP) ..... 18215986

(51) Int. Cl.

| | |
|---|---|
| ***B66B 5/22*** | (2006.01) |
| ***B66B 1/36*** | (2006.01) |
| ***B66B 3/00*** | (2006.01) |
| ***B66B 5/00*** | (2006.01) |

(52) U.S. Cl.

CPC ..... *B66B 1/365* (2013.01); *B66B 3/002* (2013.01); *B66B 5/0025* (2013.01)

(58) Field of Classification Search

CPC .. B66B 5/18; B66B 5/22; B66B 1/365; B66B 3/002; B66B 5/0025

See application file for complete search history.

(56) References Cited

U.S. PATENT DOCUMENTS 5,096,020 A * 3/1992 Korhonen ..... B66B 5/22 188/43
5,518,087 A * 5/1996 Hwang ..... B66B 5/18 187/374
5,819,879 A * 10/1998 Lang ..... B66B 5/18 187/370
6,371,261 B1 * 4/2002 Thompson ..... F16D 69/027 187/370
7,299,898 B2 * 11/2007 Husmann ..... B66B 5/20 187/373

(Continued)

FOREIGN PATENT DOCUMENTS

| | | |
|---|---|---|
| EP | 2607287 A1 | 6/2013 |
| GB | 246387 A | 1/1926 |
| WO | WO-2012/128758 A1 | 9/2012 |

OTHER PUBLICATIONS

Extended European Search Report For European Patent Application No. 18215986.3 dated Jul. 1, 2019.

*Primary Examiner* — Michael A Riegelman

(74) *Attorney, Agent, or Firm* — Harness, Dickey & Pierce, P.L.C.

(57) ABSTRACT

According to an aspect, there is provided an elevator car parking brake. An operating fork is configured to move within a housing in a direction perpendicular to an end surface of a guide rail in response to operating an actuator. When the actuator is operated to move the operating fork within the housing towards the guide rail to achieve a braking state, the operating fork is configured to push braking wedges towards side surfaces of the guide rail to contact the side surfaces. When the actuator is operated to move the operating fork within the housing away from the guide rail to achieve a brake release state, detaching means are configured to pull the braking wedges away from the side surfaces of the guide rail.

9 Claims, 3 Drawing Sheets

(56) References Cited

U.S. PATENT DOCUMENTS

| | | | | |
|---|---|---|---|---|
| 7,575,099 | B2 * | 8/2009 | Oh | B66B 5/22 187/373 |
| 9,145,282 | B2 * | 9/2015 | Schautt | B61H 7/12 |
| 9,457,989 | B2 * | 10/2016 | Meierhans | B66B 5/20 |
| 10,569,993 | B2 * | 2/2020 | Watson | B66B 5/18 |
| 2003/0085078 | A1 * | 5/2003 | Simmonds | B66B 5/22 187/373 |
| 2003/0085085 | A1 * | 5/2003 | Simmonds | B66B 5/22 188/189 |
| 2007/0051563 | A1 * | 3/2007 | Oh | B66B 5/06 187/371 |
| 2007/0272503 | A1 * | 11/2007 | Kigawa | B66B 5/18 187/379 |
| 2011/0088983 | A1 * | 4/2011 | Sirigu | B66B 5/22 187/373 |
| 2014/0008157 | A1 * | 1/2014 | Terry | B66B 1/365 187/359 |
| 2014/0332324 | A1 * | 11/2014 | Husmann | B66B 5/18 187/359 |
| 2017/0050822 | A1 * | 2/2017 | Wurth | B66B 5/12 |
| 2017/0240381 | A1 * | 8/2017 | Terry | B66B 5/04 |
| 2020/0180909 | A1 * | 6/2020 | Schulz | B66B 5/18 |
| 2020/0207576 | A1 * | 7/2020 | Koskinen | B66B 3/002 |
| 2021/0107767 | A1 * | 4/2021 | Husmann | B66B 5/18 |
| 2022/0002115 | A1 * | 1/2022 | Laine | B66B 5/22 |
| 2022/0177272 | A1 * | 6/2022 | Blochle | B66B 5/22 |

* cited by examiner

ELEVATOR CAR PARKING BRAKE

RELATED APPLICATIONS

This application claims priority to European Patent Application No. 18215986.3 filed on Dec. 31, 2018, the entire contents of which are incorporated herein by reference.

BACKGROUND

An elevator car needs to be kept within a door zone at a landing so that the car door sill and the landing door sill are on the same level for safe boarding and exit of passengers. Due to elasticity of hoisting ropes, a load change in the elevator car and the resulting tension change in hoisting ropes will move the car and create a step between the car and landing posing a tripping hazard. Relevelling of the car by machinery is a known method for preventing such tripping hazard. However, precision positioning of the car is a complex task and the dynamic load change during loading and unloading of the car will most likely make the process iterative.

A parking brake solves the problem that is due the suspension elasticity during loading and unloading. The parking brake holds the elevator in its place during loading and unloading and releases its grip after the load has been transferred to the suspension ropes and the car and landing doors have been closed, before the elevator starts to run again.

As the parking brakes are engaged at every landing stop of the elevator car, they need to be reliable and endure long-term use. Therefore, there is a need for a parking brake solution that would provide a simple but efficient parking brake.

SUMMARY

According to a first aspect, there is provided an elevator car parking brake comprising a housing having an opening configured to receive at least part of a guide rail; an actuator; an operating fork configured to move within the housing in a direction perpendicular to an end surface of the guide rail in response to operating the actuator; braking wedges arranged within the housing at opposite sides of the opening to face side surfaces of the guide rail; and detaching means attached to each braking wedge. When the actuator is operated to move the operating fork within the housing towards the guide rail to achieve a braking state, the operating fork is configured to push the braking wedges towards the side surfaces of the guide rail to contact the side surfaces. Further, when the actuator is operated to move the operating fork within the housing away from the guide rail to achieve a brake release state, the detaching means are configured to pull the braking wedges away from the side surfaces of the guide rail.

In an embodiment, the braking wedges are arranged within the housing so that slanted surfaces of the braking wedges face slanted surfaces of the operating fork.

In an embodiment, alternatively or in addition, the housing is configured to limit movement of the braking wedges only in a direction substantially perpendicular to the side surfaces of the guide rail.

In an embodiment, alternatively or in addition, the detaching means comprise a spring.

In an embodiment, alternatively or in addition, one end of the detaching means is attached to the housing or the operating fork.

In an embodiment, the actuator comprises an electric motor.

In an embodiment, the elevator car parking brake further comprises a controller configured to calculate revolutions of the electric motor when the actuator is operated to move the operating fork within the housing towards the guide rail to achieve the braking state; and determine wearing of the braking wedges based on the calculated revolutions.

In an embodiment, alternatively or in addition, the controller is configured to issue a wearing alert when the number of revolutions exceeds a predefined threshold value.

According to a second aspect, there is provided an elevator comprising an elevator car parking brake of the first aspect.

BRIEF DESCRIPTION OF THE DRAWINGS

The accompanying drawings, which are included to provide a further understanding of the invention and constitute a part of this specification, illustrate embodiments of the invention and together with the description help to explain the principles of the invention. In the drawings.

DETAILED DESCRIPTION

The following description illustrates a solution for an elevator car parking brake.

Figure 1A:
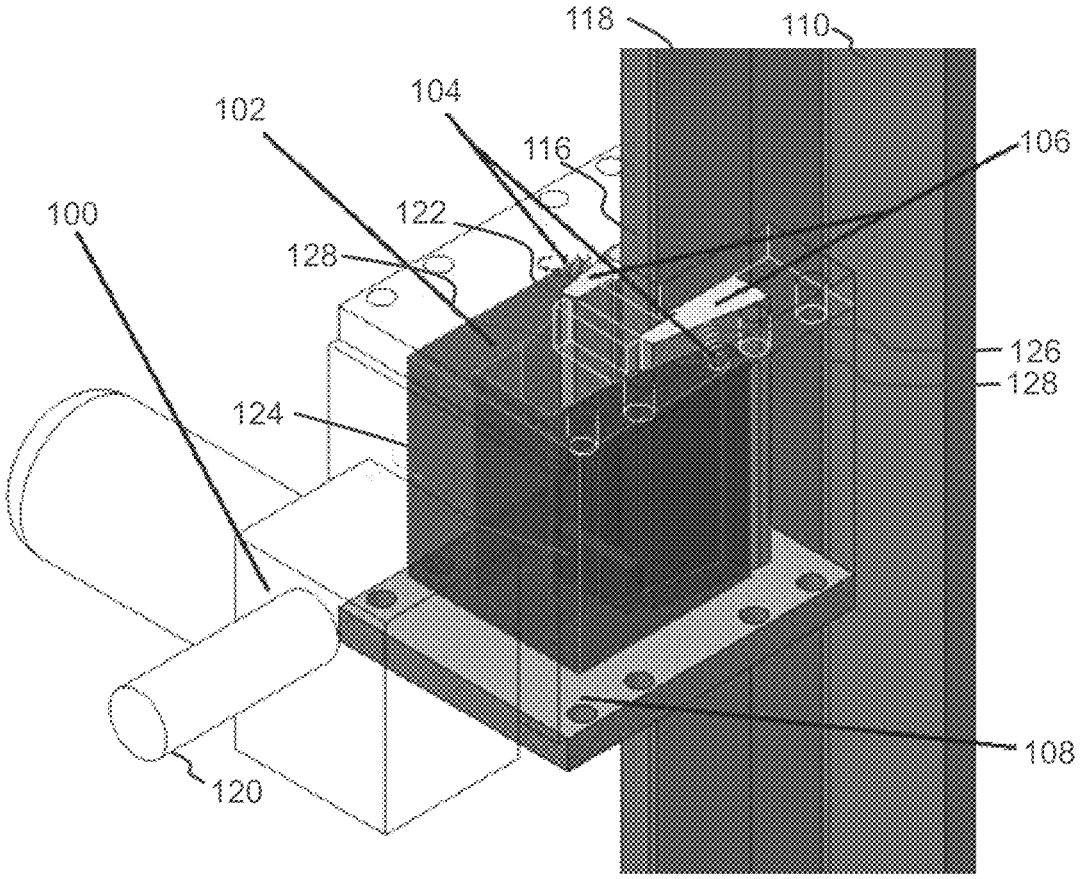
FIG. 1A illustrates an elevator car parking brake according to an embodiment.

FIG. 1A illustrates an elevator car parking brake according to an embodiment. The elevator car parking brake comprises a housing 108. The housing 108 comprises an opening configured to receive a guide rail 110. When the parking brake is not used and the elevator moves, the guide rail 110 moves in the opening without touching any parts of the housing 108.

The housing 108 may comprise a top plate and a base plate between which an operating fork or an operating member 102 is arranged. The operating fork 102 may have a cross-sectional shape of a stable or a saddle. The operating fork 102 is configured to move within the housing 108 in a direction perpendicular to an end surface 116 of the guide rail 110. As can be seen from FIG. 1A (and more clearly from FIGS. 1B and 1C), a width of the operating fork 102 may be configured to be slightly smaller than an inner width of the housing 108 to enable the operating fork 102 to move within the housing 108 in a direction perpendicular to the end surface 116 of the guide rail 110.

The elevator car parking brake comprises also an actuator 100. The operating fork 102 is configured to be moved within the housing 108 in a direction perpendicular to the end surface of the guide rail 110 in response to operation of the actuator 100. The actuator 100 may comprise a bar 120 or other element that moves to push the operating fork 102 when the parking brake is engaged and pull the operating fork 102 when the parking brake is disengaged.

The elevator car parking brake further comprises braking wedges 106 arranged within the housing 108 at opposite sides of the opening 114 to face side surfaces 118 of the guide rail 110. As can be seen from FIG. 1A, an inner surface of the braking wedge 106 may be arranged in parallel with respect to the side surface 118 of the guide rail 110. An outer surface 126 of the braking wedge 106 may be slanted with respect to the inner surface 122 of the braking wedge 106. In one embodiment, as illustrated in FIG. 1A, the braking wedges 106 may be arranged within the housing 108 so that slanted surfaces of the braking wedges 106 face slanted surfaces 128 of the operating fork 102.

The elevator car parking brake also comprises detaching means 104 attached to each braking wedge 106. The detaching means 104 may comprise springs or any other means that are able to pull the braking wedges 106 away from the side surfaces 118 of the guide rail 110 upon disengaging of the parking brake.

Figure 1B:
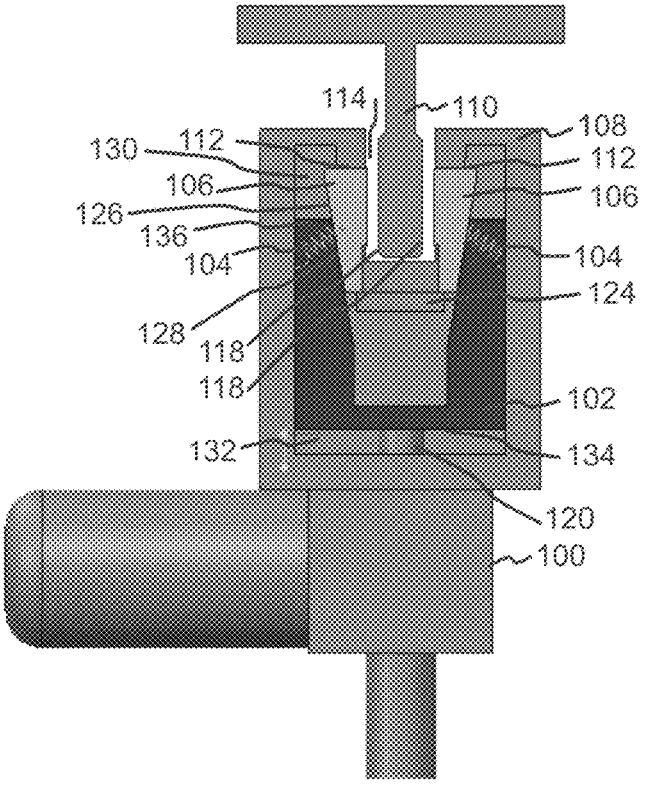
FIG. 1B illustrates a top view of the elevator car parking brake illustrated in FIG. 1A.

FIG. 1B illustrates a cross-sectional top view of the elevator car parking brake illustrated in FIG. 1A. More specifically, FIG. 1B illustrates a situation where the actuator 100 (or the bar 120) has started to push the operating fork 102 towards the guide rail 110 to engage the parking brake. When the actuator 100 is operated to move the operating fork 102 within the housing 108 towards the guide rail 110 to achieve a braking state, the operating fork 102 is configured to push the braking wedges 106 towards the side surfaces 118 of the guide rail 110 to contact the side surfaces 118. As can be seen from FIG. 1B, a first space 132 between a lower end portion 134 of the operating fork 102 and an inner surface of the housing 108 grows and a second space 130 between an upper end portion 136 of the operating fork 102 and an inner surface of the housing 108 decreases.

At the same time, the slanted surface 128 of the operating fork 108 pushes against the slanted surface 126 of the braking wedge 106, thus causing the braking wedge 106 to move towards the side surface 118 of the guide rail 110.

As can be seen from FIG. 1B, the housing 108 may be configured to limit movement of the braking wedges 106 only in a direction substantially perpendicular to the side surfaces 118 of the guide rail 110. The movement limitation may be achieved, for example, with a guide 124, supported between the top and base plates of the housing 108, and end surfaces 112 of the housing 108. The top and base plates of the housing 108 may be machined to accommodate braking wedges 106 that are slightly higher than the operating fork 102 such that only a braking wedge 106 movement perpendicular to operating fork 102 movement is enabled.

Figure 1C:
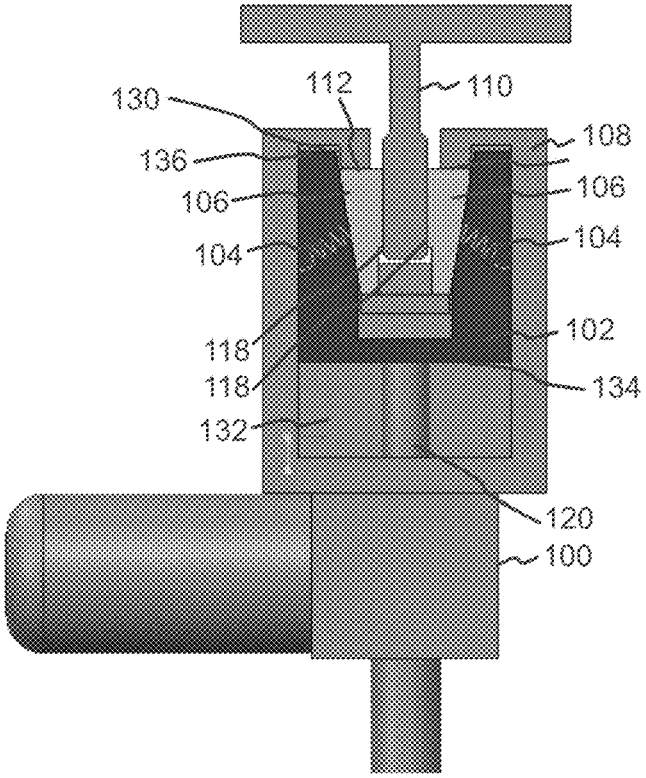
FIG. 1C illustrates another top view of the elevator car parking brake illustrated in FIG. 1A.

FIG. 1C illustrates another cross-sectional top view of the elevator car parking brake illustrated in FIG. 1A. More specifically, FIG. 1C illustrates a situation where the elevator car parking brake has reached a braking state. In the braking state, the braking wedges 106 press against the side surfaces 118 of the guide rail 110 and the detaching means 104 are in an extended state. As can be seen by comparing FIGS. 1B and 1C, the first space 132 between the lower end portion 134 of the operating fork 102 and the inner surface of the housing 108 has grown significantly and the second space 130 between the upper end portion 136 of the operating fork 102 and the inner surface of the housing 108 has decreased significantly.

When the actuator 100 is operated again to move the operating fork 102 within the housing 108 away from the guide rail 110 to achieve a brake release state, the detaching means 104 are configured to pull the braking wedges 106 away from the side surfaces 118 of the guide rail 110. In an embodiment, one end of the detaching means 104 may be attached or fixed to the housing 108. In another, alternative embodiment, one end of the detaching means 104 may be attached or fixed to the operating fork 102.

As a summary of FIGS. 1A-1C, the elevator car parking brake works in such a way that when the elevator is ready to move and suspension rope forces are balanced, the operating fork 102 is pulled back to a retracted position within the housing 108 and the detaching means 104 pull the braking wedges 106 off from the guide rail 110 and elevator is free to move. The movement of the braking wedges 106 may be designed so that a gap between the side surfaces 118 of the guide rail 110 and braking wedges 106 is big enough when the elevator moves. When the elevator stops for loading and unloading, the parking brake is engaged by pushing the operating fork 102 forward by the actuator 100. The operating fork 102 then pushes the braking wedges 106 against the side surfaces 118 of the guide rail 110.

Although not shown in FIGS. 1A-1C, the housing 108 may prevent the movement of the braking wedges 106 in other directions that towards the guide rail 110/away from the guide rail 110.

Figure 2:
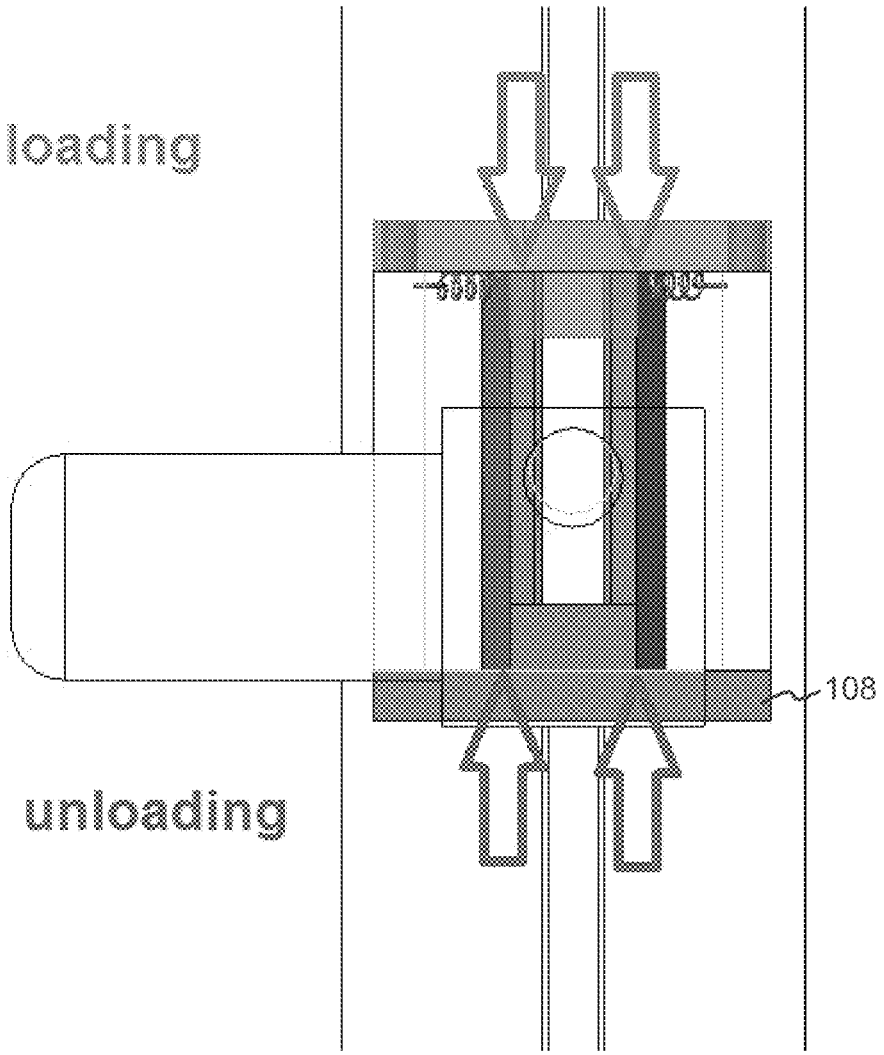
FIG. 2 illustrates an embodiment where the housing transmits a change of load to braking wedges.

In one embodiment, the housing 108 may be fixed to a sling of an elevator car. As illustrated in FIG. 2, when the load inside the car changes, the elevator car would move up or down due to the changed tension in the suspension ropes without the parking brake keeping it stationary by transmitting the force resulting from the load change to the guide rails.

In one embodiment, the actuator 100 comprises an electric motor. Further, the elevator car parking brake may comprise a controller configured to calculate revolutions of the electric motor, for example by an encoder, when the actuator 100 is operated to move the operating fork 102 within the housing 108 towards the guide rail 110 to achieve the braking state, and determine wearing of the braking wedges 106 based on the calculated revolutions. In other words, when the braking wedges 106 wear out, they need to be moved a longer distance towards the side surfaces 118 of the guide rail 110 in order to achieve a proper braking state. This means that the electric motor has to be operated longer (i.e. the number of revolutions performed by the electric motor increases) in order to achieve a proper braking state. The controller may also be configured to issue a wearing alert when the number of revolutions exceeds a predefined threshold value. This may also mean that the braking wedges may need to be replaced with new ones.

In other embodiments, the actuator may comprise an electro-mechanical linear actuator, a hydraulic cylinder or a pneumatic cylinder.

An elevator of an elevator system may comprise at least one elevator car parking brake discussed above.

The illustrated solution provides a compact elevator car parking brake. Further, the actuator can be placed between top beams of a sling and under a roller guide bracket. The working principle of the solution is simple and it does not need an extensive number of components. This means that the solution is reliable and long-lasting.

Further, when using braking wedges, they amplify the thrust so that the actuator can be relatively small. As an example, when a 10-degree wedge angle is used, a 25 kN compression force can be reached approximately with a 5 kN thrust force. Further, to achieve a 5 mm air gap between the guide rail 110 and braking wedges 106, the movement of the operating fork 102 is approximately 25 mm.

While there have been shown and described and pointed out fundamental novel features as applied to preferred embodiments thereof, it will be understood that various omissions and substitutions and changes in the form and details of the devices and methods described may be made by those skilled in the art without departing from the spirit of the disclosure. Moreover, it should be recognized that structures and/or elements and/or method steps shown and/ or described in connection with any disclosed form or embodiments may be incorporated in any other disclosed or described or suggested form or embodiment as a general matter of design choice. Furthermore, in the claims means-plus-function clauses are intended to cover the structures described herein as performing the recited function and not only structural equivalents, but also equivalent structures.

The applicant hereby discloses in isolation each individual feature described herein and any combination of two or more such features, to the extent that such features or combinations are capable of being carried out based on the present specification as a whole, in the light of the common general knowledge of a person skilled in the art, irrespective of whether such features or combinations of features solve any problems disclosed herein, and without limitation to the scope of the claims. The applicant indicates that the disclosed aspects/embodiments may consist of any such individual feature or combination of features. In view of the foregoing description it will be evident to a person skilled in the art that various modifications may be made within the scope of the disclosure.

The invention claimed is:

1. An elevator car parking brake comprising:

a housing having an opening configured to receive at least part of a guide rail;

an actuator;

an operating fork configured to move within the housing in a direction perpendicular to an end surface of the guide rail in response to operating the actuator;

braking wedges arranged within the housing at opposite sides of the opening to face side surfaces of the guide rail;

detaching means attached to each braking wedge;

when the actuator is operated to move the operating fork within the housing towards the guide rail to achieve a braking state, the operating fork is configured to push the braking wedges towards the side surfaces of the guide rail to contact the side surfaces; and when the actuator is operated to move the operating fork within the housing away from the guide rail to achieve a brake release state, the detaching means are configured to pull the braking wedges away from the side surfaces of the guide rail.

2. The elevator car parking brake of claim 1, wherein the braking wedges are arranged within the housing so that slanted surfaces of the braking wedges face slanted surfaces of the operating fork.

3. The elevator car parking brake of claim 1, wherein the housing is configured to limit movement of the braking wedges only in a direction substantially perpendicular to the side surfaces of the guide rail.

4. The elevator car parking brake of claim 1, wherein the detaching means comprise a spring.

5. The elevator car parking brake of claim 1, wherein one end of the detaching means is attached to the housing or the operating fork.

6. The elevator car parking brake of claim 1, wherein the actuator comprises an electric motor.

7. The elevator car parking brake of claim 6, further comprising a controller configured to:

calculate revolutions of the electric motor when the actuator is operated to move the operating fork within the housing towards the guide rail to achieve the braking state; and determine wearing of the braking wedges based on the calculated revolutions.

8. The elevator car parking brake of claim 7, wherein the controller is configured to issue a wearing alert when the number of revolutions exceeds a predefined threshold value.

9. An elevator comprising an elevator car parking brake of claim 1.

* * * * *